US011134782B2

(12) United States Patent
Stousland

(10) Patent No.: US 11,134,782 B2
(45) Date of Patent: Oct. 5, 2021

(54) FLIP LOUNGE CHAIR

(71) Applicant: Grant Stousland, Middleton, WI (US)

(72) Inventor: Grant Stousland, Middleton, WI (US)

( * ) Notice: Subject to any disclaimer, the term of this patent is extended or adjusted under 35 U.S.C. 154(b) by 17 days.

(21) Appl. No.: 16/841,752

(22) Filed: Apr. 7, 2020

(65) Prior Publication Data

US 2020/0329871 A1 Oct. 22, 2020

Related U.S. Application Data

(60) Provisional application No. 62/836,771, filed on Apr. 22, 2019.

(51) Int. Cl.

| | |
|---|---|
| ***A47C 3/00*** | (2006.01) |
| ***A47C 7/02*** | (2006.01) |
| ***A47C 1/14*** | (2006.01) |

(52) U.S. Cl.

CPC ..... *A47C 3/00* (2013.01); *A47C 1/143* (2013.01); *A47C 7/0213* (2018.08)

(58) Field of Classification Search

None

See application file for complete search history.

(56) References Cited

U.S. PATENT DOCUMENTS 389,174 A * 9/1888 Sutton ..... A47C 1/028 297/93
1,411,978 A * 4/1922 Page ..... B60N 2/305 297/93
2,314,130 A * 3/1943 Davis ..... A47C 1/028 297/93
D177,783 S * 5/1956 Witty ..... D6/367
2,784,768 A * 3/1957 Holopainen ..... B60N 2/203 297/93
3,175,860 A * 3/1965 Tcherniavsky ..... A47C 1/028 297/93
3,227,467 A * 1/1966 Fugitt, Sr. ..... A47C 15/00 280/47.25
3,271,796 A * 9/1966 Dillman ..... A47C 5/06 5/625
3,680,918 A * 8/1972 Briggs ..... A47C 13/00 297/452.41
3,751,740 A * 8/1973 Belk ..... B60N 2/203 5/37.1
4,010,977 A * 3/1977 Rahman ..... B60N 2/203 297/92
4,136,888 A * 1/1979 Bowie, Jr. ..... A61G 5/066 280/47.25
4,997,234 A * 3/1991 Royle ..... A47C 3/029 297/271.6
5,098,154 A * 3/1992 Emery ..... B60N 2/0292 297/328

(Continued)

FOREIGN PATENT DOCUMENTS

| | | |
|---|---|---|
| CA | 2978802 | 3/2018 |
| CN | 202312314 | 7/2012 |

(Continued)

*Primary Examiner* — David E Allred

(74) *Attorney, Agent, or Firm* — Andrus Intellectual Property Law, LLP

(57) ABSTRACT

A lounge chair includes a support structure that is designed to allow the chair to be positioned in a forward facing position, and also be flipped rearwards so that it can be usable as a chair when facing in a rearward position.

17 Claims, 11 Drawing Sheets

(56) References Cited

U.S. PATENT DOCUMENTS

| | | | | |
|---|---|---|---|---|
| 7,921,487 | B2 | 4/2011 | Stonier | |
| 8,418,282 | B2 | 4/2013 | Luft-Weissberg | |
| 8,438,676 | B2 | 5/2013 | Murphy | |
| 8,997,273 | B2 | 4/2015 | Murphy et al. | |
| 9,420,889 | B2 | 8/2016 | Murphy | |
| 2013/0328367 | A1* | 12/2013 | Yestadt | A47C 1/028 297/239 |
| 2014/0143949 | A1 | 5/2014 | Erdman et al. | |
| 2014/0352056 | A1 | 12/2014 | Thurow | |
| 2016/0150888 | A1 | 6/2016 | Thurow | |
| 2017/0071353 | A1 | 3/2017 | Murphy | |
| 2017/0332797 | A1 | 11/2017 | Thurow | |
| 2018/0064258 | A1 | 3/2018 | Murphy | |
| 2018/0078045 | A1 | 3/2018 | Neighbours | |

FOREIGN PATENT DOCUMENTS

| | | | | |
|---|---|---|---|---|
| CN | 203506130 | | 4/2014 | |
| DE | 3422038 | A1 * | 12/1985 | A47C 1/028 |
| EP | 2 172 136 | | 4/2010 | |
| EP | 2 583 592 | | 4/2013 | |
| EP | 2 901 895 | | 8/2015 | |
| WO | 00 25636 | | 5/2000 | |

* cited by examiner

FLIP LOUNGE CHAIR

FIELD OF THE INVENTION

The invention is directed to a flip lounge chair or sofa, where the chair or sofa back serves as the seat platform when the chair or sofa is flipped.

BACKGROUND OF THE INVENTION

Sometimes it is a hassle to move furniture, for example when guests are visiting and furniture needs to be rearranged for a different purpose than it is ordinarily used. The invention addresses this issue by providing a chair or sofa that is able to be flipped easily backward, instead of lifted and turned, and still be used normally like it would have been used in its forward position, but now facing in the opposite direction. The invention allows the furniture to be rearranged without heavy lifting and turning.

SUMMARY OF THE INVENTION

The invention is directed to a lounge chair or sofa to be flipped to face forward or rearward and be used as a seat in the opposite direction. The lounge chair includes a first seat platform and a second seat platform where the first seat platform serves as the seat of the chair and the second seat platform serves as a chair back when the chair is in a forward position. When the chair is flipped into the rearward position, the second seat platform serves as the seat of the chair and the first seat platform serves as the chair back. The lounge chair includes a support structure for the first and second seat platforms that is configured to support the chair in the forward position with the first seat platform serving as the seat of the chair and also in the rearward position with the second seat platform serving as the seat of the chair.

In the preferred embodiment of the invention, the support structure comprises first and second support rails which are each connected to the first and second seat platforms preferably with the first crossbar that is near the front edge of the first seat platform and a second crossbar that is near the front edge of the seat of the second platform. Each of the first and second rails has a first leg having a proximal end that is attached to the first seat platform and preferably the crossbar, near front edge of the chair and a distal end that is attached to the front end of a first rail footing. The first rail footing extends in a plane substantially parallel to the first seat platform. Each of the first and second rails also include a second leg having a proximal end attached to the second platform, and preferably the second crossbar, near a front edge of the seat and a distal end attached to a front end of the second rail footing that extends in a plane substantially parallel to the second seat platform. An arcing rail transition connects the rear end of the of the first rail footing to the rear end of the second rail footing. The height of the first leg on the first and second rail sets the seat height for the first seat platform and the length of the second legs on the first and second rail sets the seat height for the second platform when the chair is flipped into the rearward position. In the exemplary embodiment, the length of the first legs and the second legs are the same so that the seat height in the forward direction is the same as when the chair is flipped in the rearward direction. The arcing rail transitions enable the chair to be smoothly flipped by lifting the seat without having to lift the full weight of the chair. It is preferred that the rail transitions be located farther rearward from the front edge of the seat than the chair back when the chair is in the forward position and flipped into the rearward position. This configuration provides stability to the chair when it is both in the forward and rearward position. The rails can be made of separates pieces connected together, or can be made of one continuous tube that is bent to shape.

When the chair is in the forward direction, the first seat platform lies substantially in a first seat plane and the second seat platform lies substantially in a second seat plane. The first and second seat planes intersect at a seat back inclination angle which is desirably greater than 90°, for example about 110°. In the exemplary embodiment, each of the first and second seat platforms are planar and the seat transition panel spans between the first and second seat platforms to form a continuous surface between the seat and the back portions of the chair.

Cushions may be provided for the chair as well. In this regard, the chair includes a first cushion attached to the first seat platform and a second cushion attached to the second seat platform. In the exemplary embodiment, where the first and second seat platforms are planar, the cushions can be attached using magnets. For example, the first seat platform includes inlaid magnets and the first cushion includes an exposed side, a hidden side, magnets and a template for holding the magnets in a fixed position corresponding to the location of the inlaid magnets in the first seat platform. Likewise, the second seat platform includes inlaid magnets and the second cushion includes an exposed side, a hidden side, magnets and a template for holding the magnets in a fixed position corresponding to the location of the inlaid magnets on the second seat platform. The magnets on the seat platforms can be attached using the same screws that are used to attach the crossbars and the first and second legs to the respective seat platforms.

The use of rails made of chrome-plated steel tubing for the support structure is particularly advantageous because of the weight and the ability of the configuration to provide a stable chair whether in the forward position or the rearward position. The invention can be carried out with the support structure having similar features but made out of other materials of course. Aluminum, wood, carbon or other material can be used as long as the weight is such that it meets furniture industry safety and strength standards. Heavier material weights the base and has the advantage of it being more difficult to rock the chair backward. As mentioned, the rails can be made of separates pieces connected together, or can be made of one continuous tube that is bent to shape. In addition, the seat platforms in the exemplary embodiment are made of wood, with the cushions being removably attached, e.g. using magnets. It may be desirable to use other materials for the seat platforms and provide permanently attached cushions, or no cushions at all. For example, the invention could be implemented with or without cushions as patio furniture where the support structure and the seat platforms are made of materials commonly used for outside furniture.

In addition, it is possible within the scope of the invention that the chair has seat platforms that are large enough to accompany more than one person, such as a love seat or sofa configuration.

Other variations and modifications to the invention may be apparent to those skilled in the art upon reviewing the drawings and following description thereof.

DETAILED DESCRIPTION

Figure 1:
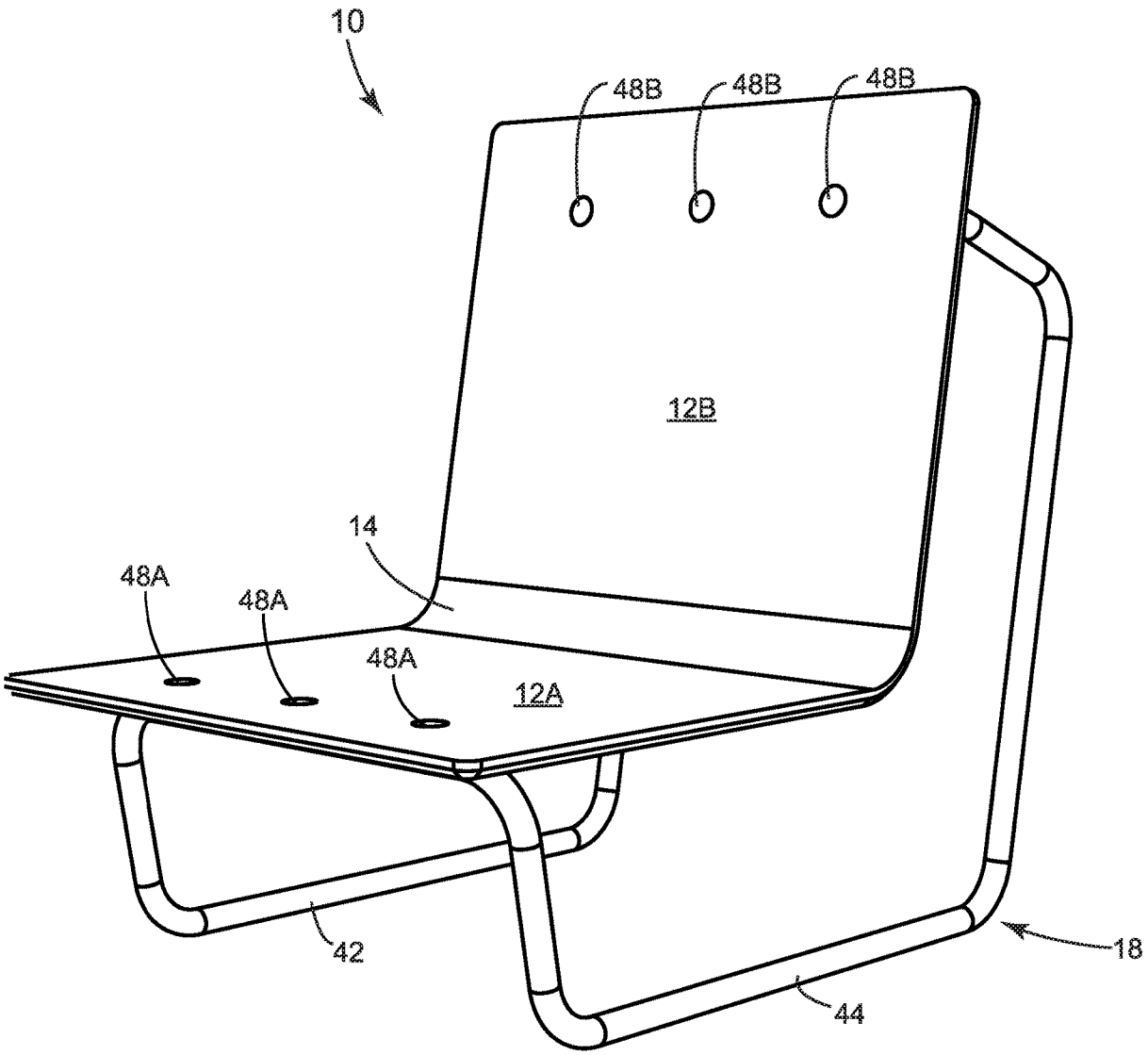
FIG. 1 is a perspective view of an exemplary embodiment of a flip chair constructed in accordance with the invention.
Figure 2:
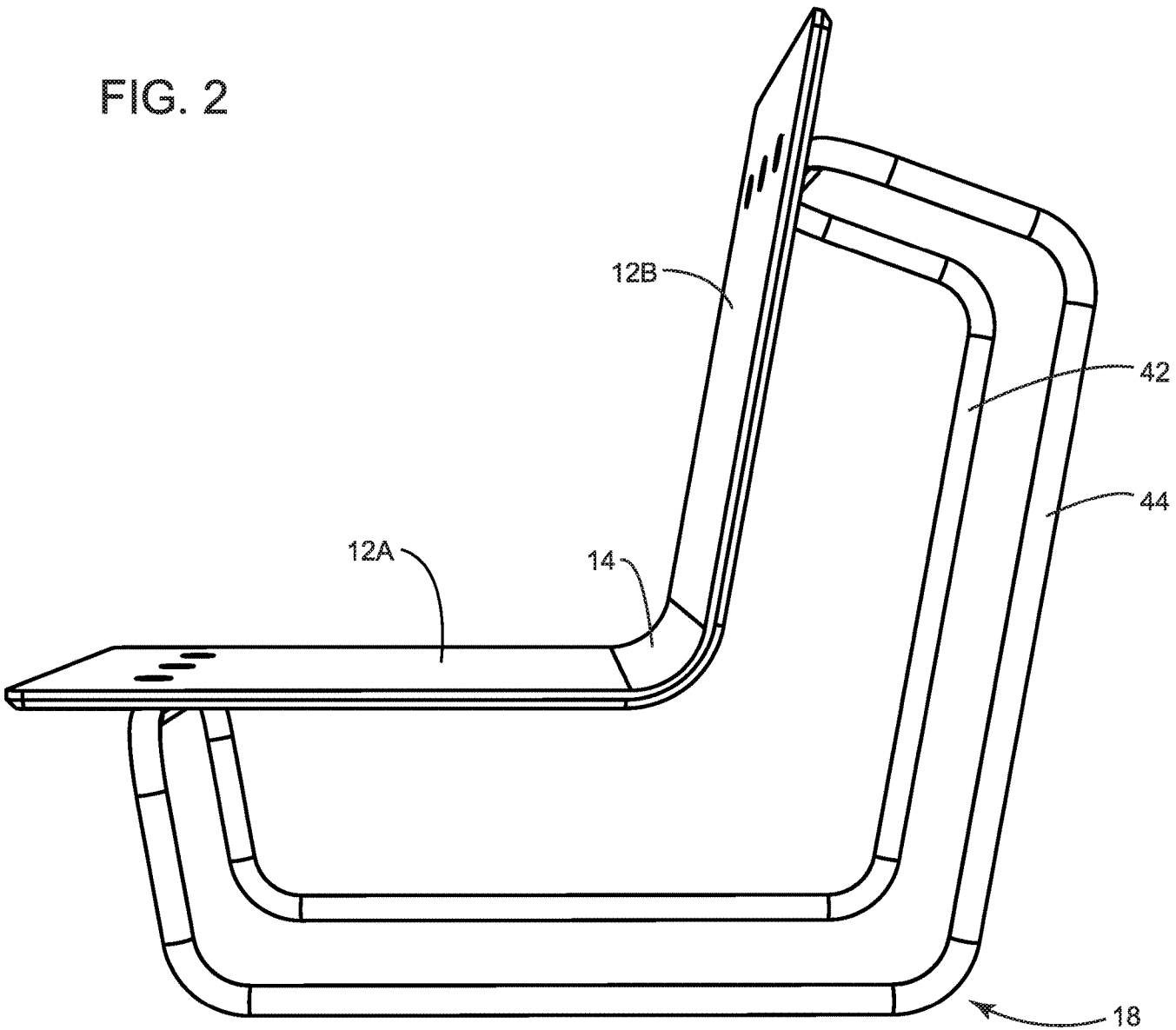
FIG. 2 is a side semi-perspective view showing the flip chair in FIG. 1 from a different perspective.
Figure 3:
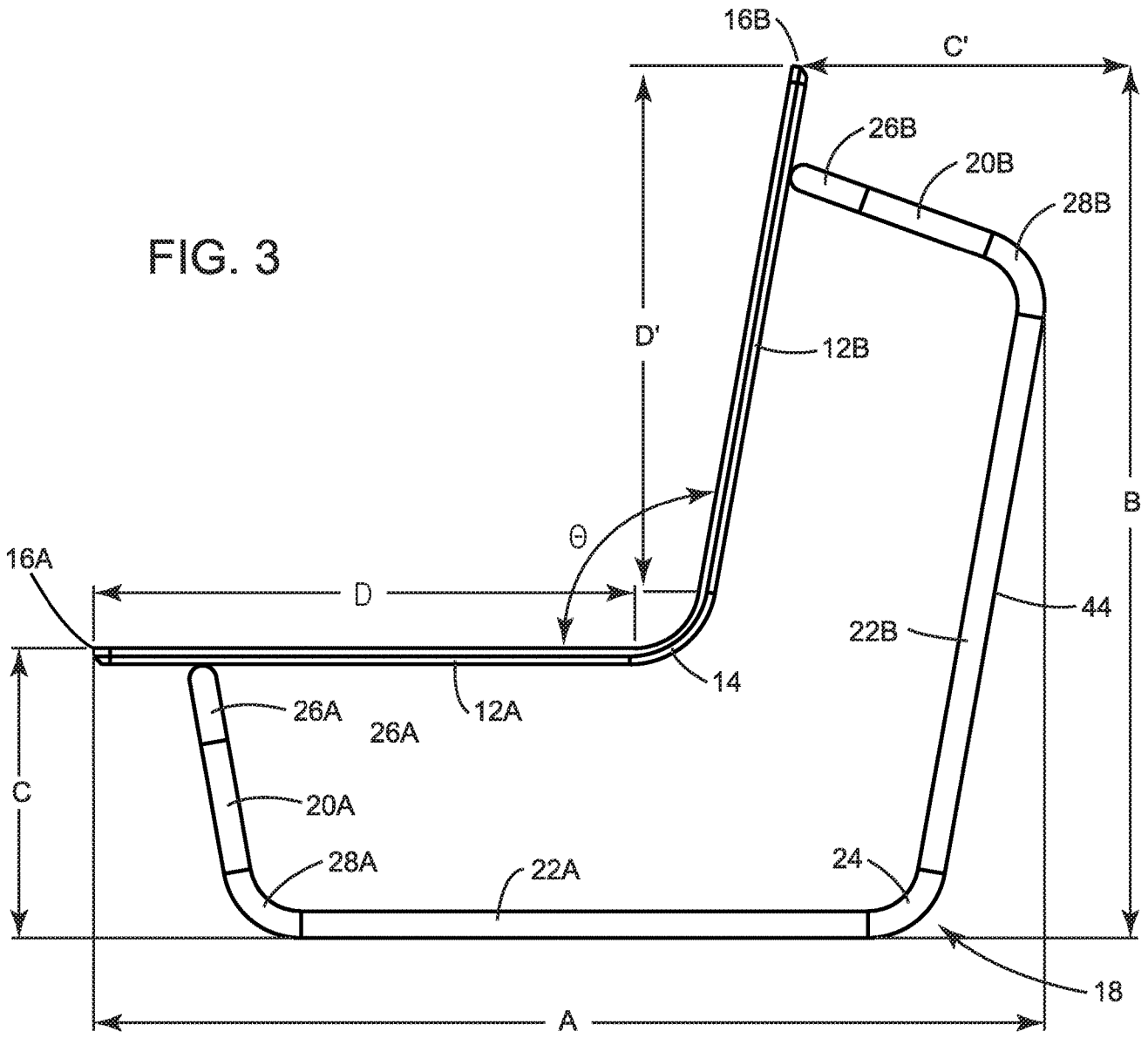
FIG. 3 is a side elevational view of the flip chair shown in FIGS. 1 and 2.
Figure 8:
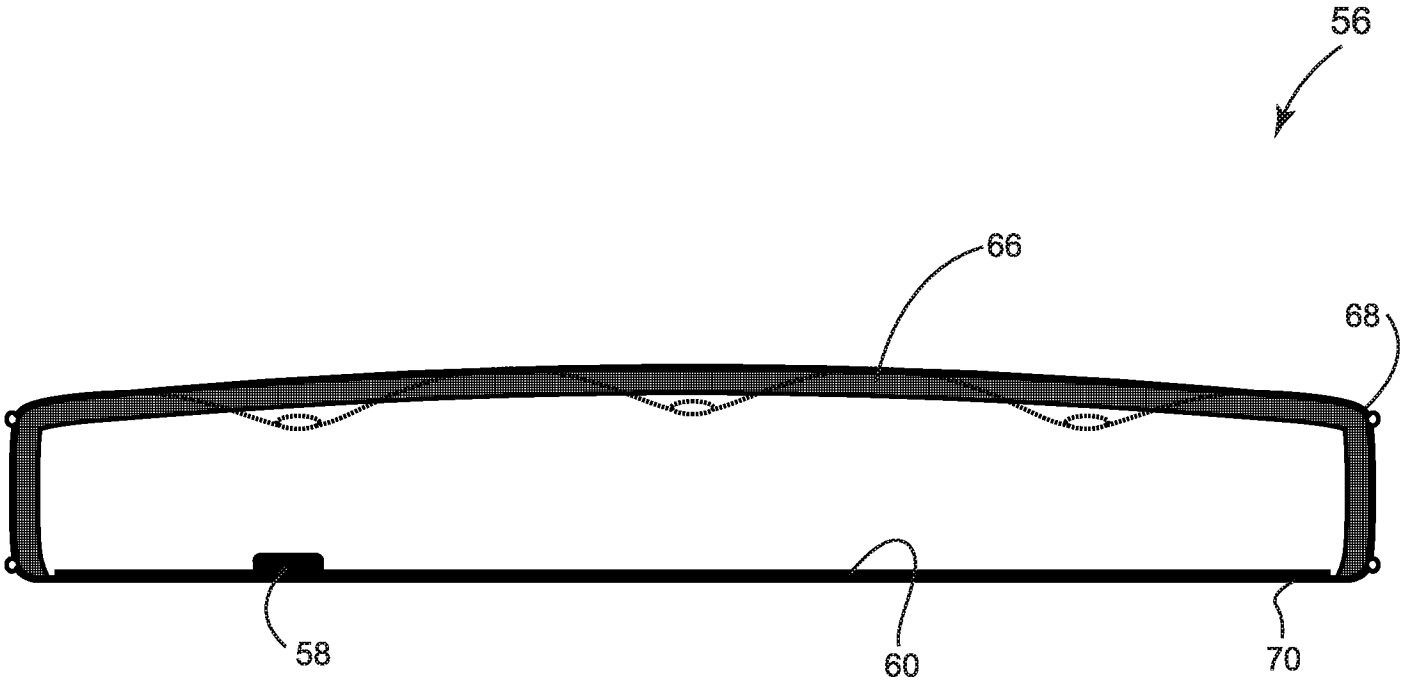
FIG. 8 is a cross sectional view of a cushion constructed in accordance with an exemplary embodiment of the invention.

The figures illustrate an exemplary embodiment of a flip chair 10 that is constructed in accordance with the invention. Referring in particular to FIGS. 1 and 2, the flip chair includes a first seat platform 12A, and a second seat platform 12B. In FIGS. 1 and 2, the first seat platform 12A serves as the seat for the chair 10, and the second seat platform 12B serves as the back for the chair. For the sake of discussion, the chair 10 in FIGS. 1 and 2 is facing the forward facing direction. When the chair 10 is flipped to the rearward facing direction, the second seat platform 12B serves as the seat of the chair and the first seat platform 12A serves as the back of the chair 10. In the embodiment shown in the drawings, including FIGS. 1 and 2, the seat platforms 12A and 12B as well as the other components are generally symmetrical so the chair 10 has similar dimensions for sitting whether it is facing a forward direction or a rearward direction. The first seat platform 12A and second seat platform 12B are connected by a platform transition component 14 in the embodiment shown in the figures. The chair 10 also includes a first rail 42 and a second rail 44 which support the chair 10 whether the chair 10 is positioned facing forward or rearward. FIGS. 1 and 2 also show inlaid magnets 48A on the first seat platform 12A and inlaid magnets 48B on the second seat platform 12B. These inlaid magnets 48A, 48B are used to magnetically attach cushions also having magnets as shown in FIGS. 8 and 3. The cushions 56 and the magnetic attachment of the cushions 56 is an optional feature. In addition, while using magnets to attach the cushions in particularly convenient, other ways of attaching the cushions 56 can be used as well.

Figure 4:
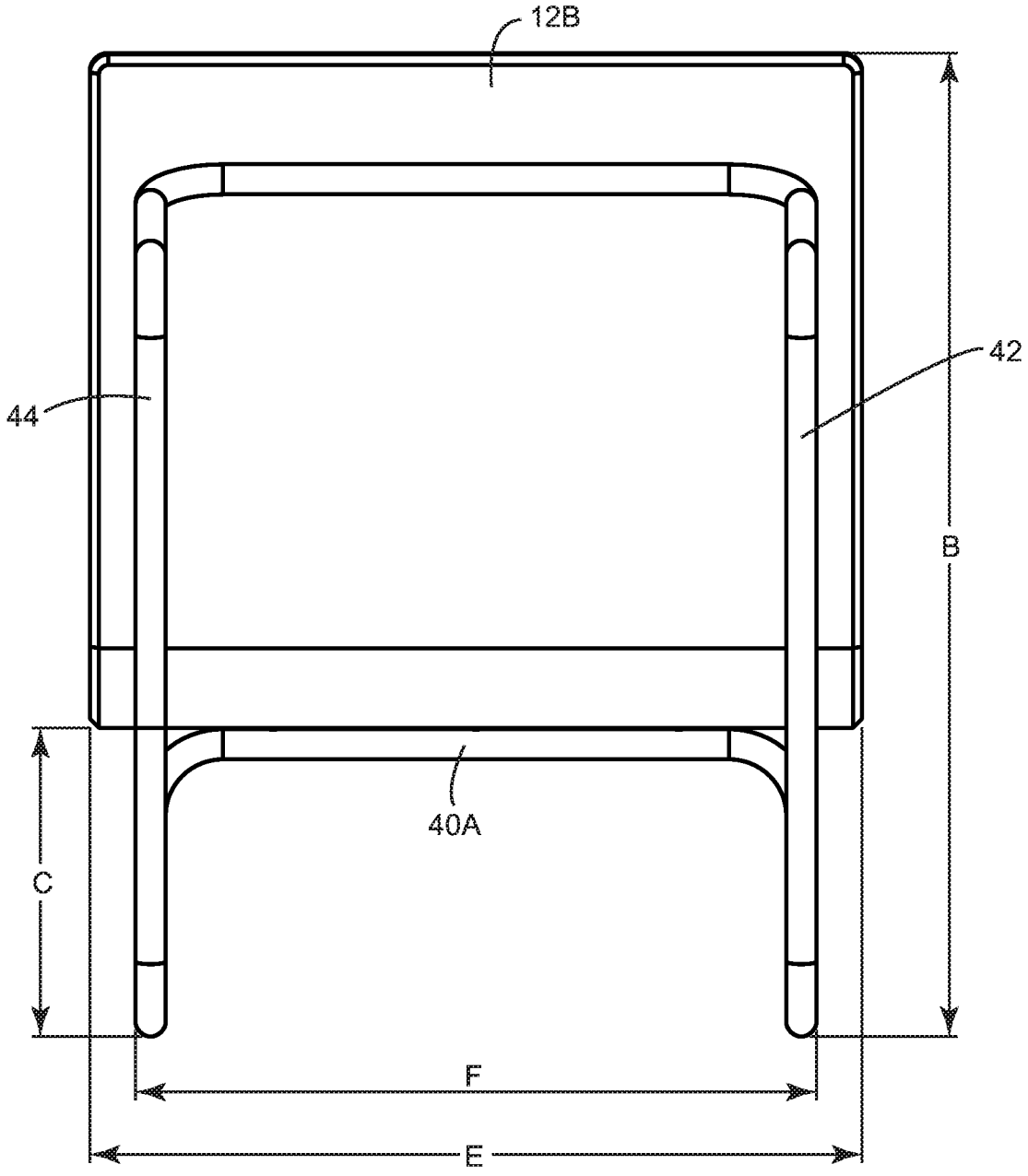
FIG. 4 is a rear elevational view of the flip chair shown in FIGS. 1 through 3.

Referring now in particular to FIGS. 3 through 6, the first and second seat platforms 12A, 12B are planar and substantially flat, which facilitates comfortable seating and reliable attachment of the cushions. As shown in FIG. 3, the first seat platform 12A lies in a first seating plane. The second seat platform 12B, which is serving as the chair back in FIG. 3, lies in a second seating plane. The planes intersect at a seat back inclination angle θ, which is preferably slightly greater than 90°. In FIG. 3, the transition angle θ is approximately 110°. The angle θ should be 90° or greater, and desirably no greater than 120°, although reclined chair back up to 135° or so may be desirable for some designs. In the embodiment shown in the drawings the first seat platform 12A, second seat platform 12B and the platform transition 14 are made of finished wood or wood veneer although the seat platforms can be made of different materials. The use of the platform transition 14 enables the first seat platform and second seat platform to be supported without the use of additional chair legs. The seat depth D between the platform transition 14 and the front seat edge 16A is somewhat a matter of choice, and in the embodiment shown in FIG. 3 is 25¼". The seat depth of the second seat platform 12B between the platform transition and the front seat edge 16B is preferably the same distance. The support structure 18 for the chair 10 can be made out of various materials. In the embodiment shown in the drawings, the support structure is made of a generally continuous chrome-plated, steel tubular rail, 1¼" outside diameter. To reiterate, the tubular rails making the support structure can be made of separates pieces of rail connected together, or can be made of one continuous tube that is bent to shape. Referring to briefly to FIG. 4, the support structure 18 has a first rail 42 which spans on the back or underside of the first and second seat platforms 12A, 12B on one side and a second rail 44 which spans on the other side. A cross-support rail 40A connects the first rail 42 and the second rail 44 underneath the first seat platform 12A and a second cross-support rail 40B connects the first rail 42 and the second rail 44 on the back side of the second seat platform 12B. The height of the chair, namely how high the chair back sits above the ground, is identified by arrow B. In this exemplary embodiment the chair height B is 40¾". Still referring to FIG. 4, the chair width, namely the distance between the lateral edges of the first seat platform, second seat platform and platform transition 14 is depicted by arrow E, and in the exemplary embodiment is 32". The first rail 42 and the second rail 44 run essentially parallel with the respective lateral edges of the first seat platform 12A and the second seat platform 12B. The distance between the outer edges of the rails 42, 44 is depicted by arrow F and is 28¼" in the exemplary embodiment. The positioning of the first rail 42 and the second rail 44 relatively close to the edges of the seat platforms 12A, 12B renders the chair stable in the lateral tipping directions.

Referring now in particular to FIG. 3, the details of the second rail 44 can be seen in the side elevational view. In the exemplary embodiment, the structure and configuration of the first rail 42 (FIG. 4) is symmetrical with the second rail 44. The rail 44 includes leg 20A and proximal leg transition 26A and distal leg transition 28A, which extend downward from the underside or back side of the first seat platform 12A near the front seat edge 16A. The proximal leg transition 26A connects to the cross-support rail 40A (shown in FIGS. 4 and 5). The distal leg transition 28A is connected to a rail footing 22A. The rail footing 22A is parallel to the first seat plane, so that the first seat platform 12A remains parallel to the ground when the chair 10 is in the position shown in FIG. 3. Similarly, a proximal leg transition 26B, a leg 20B and a distal leg transition 28B extend from the back or underside of the second seat platform 12B to another rail footing 22B. The rail footings 22A and 22B are connected together with a rail transition 24. The angle of the rail transition is desirably the same as the seat back inclination angle θ. This means that the rail footing 22A is parallel with the first seat plane in which the first seat platform 12A lies and rail footing 22B is parallel with the second seat plane in which the second seat platform 12B lies. The height of the first seat platform 12A is depicted by the arrow C when the chair is in the position shown in FIG. 3, and the height of the second seat platform 12B is depicted by the arrow C' when the chair 10 is flipped to a rearward sitting position from that shown in FIG. 3. In the embodiment shown in the figures, the seat height C and C' are the same, and are preferably 13½". The overall chair depth as measured from the front seat edge 16A for the first seat platform 12A rearward to the farthest edge of the support structure 18, namely the distal leg transition 28B, is depicted by arrow A. In the preferred embodiment, the overall chair depth A is 44¼". Notably, the overall chair depth A is greater than the chair height B. The overall chair depth A and the overall chair height B are desirably the same if the chair 10 is flipped to be supported on the rail footing 22B as they are when the chair is supported by the rail footing 22A.

Figure 5:
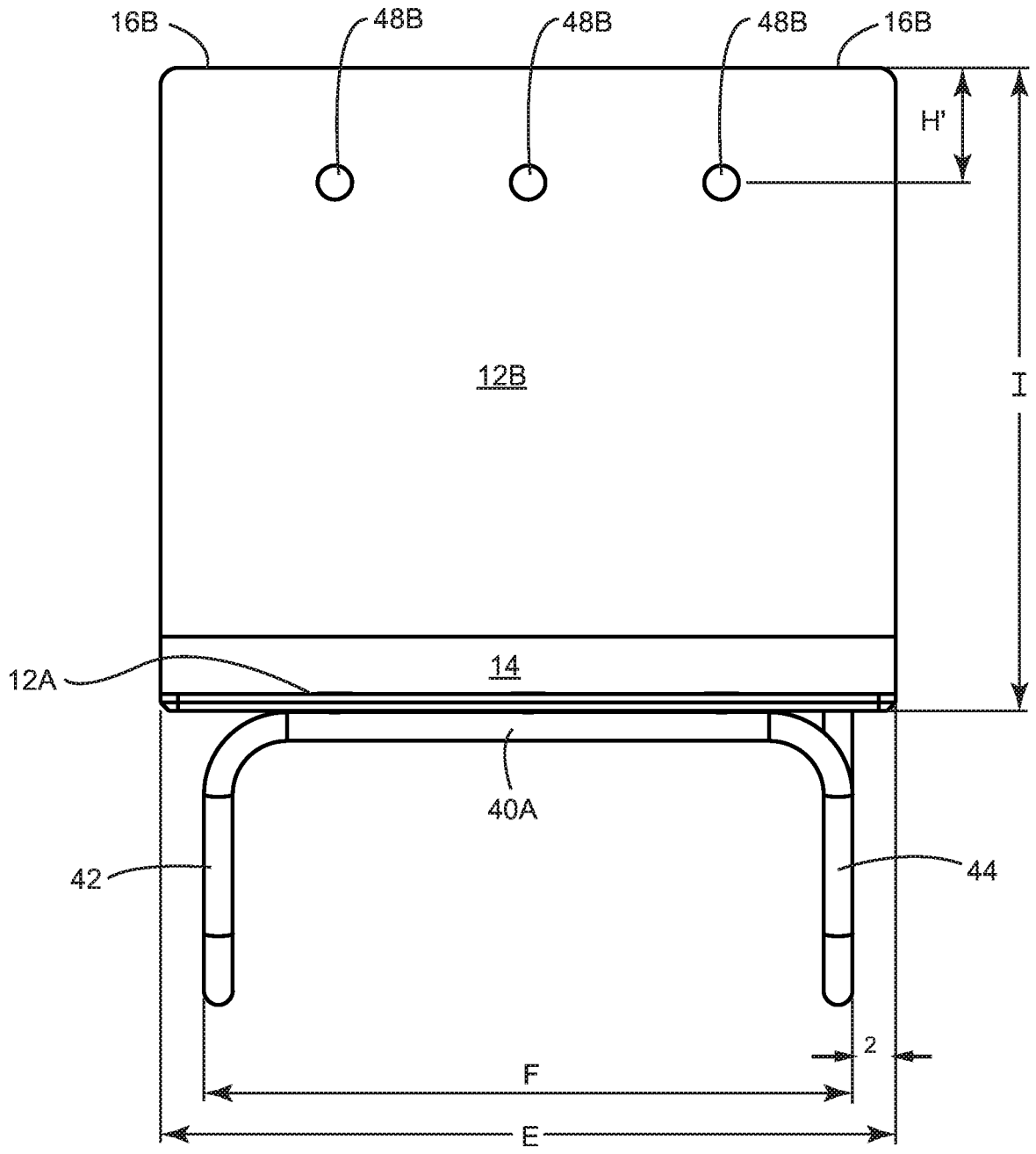
FIG. 5 is a front elevational view of the flip chair shown in FIGS. 1 through 4.
Figure 6:
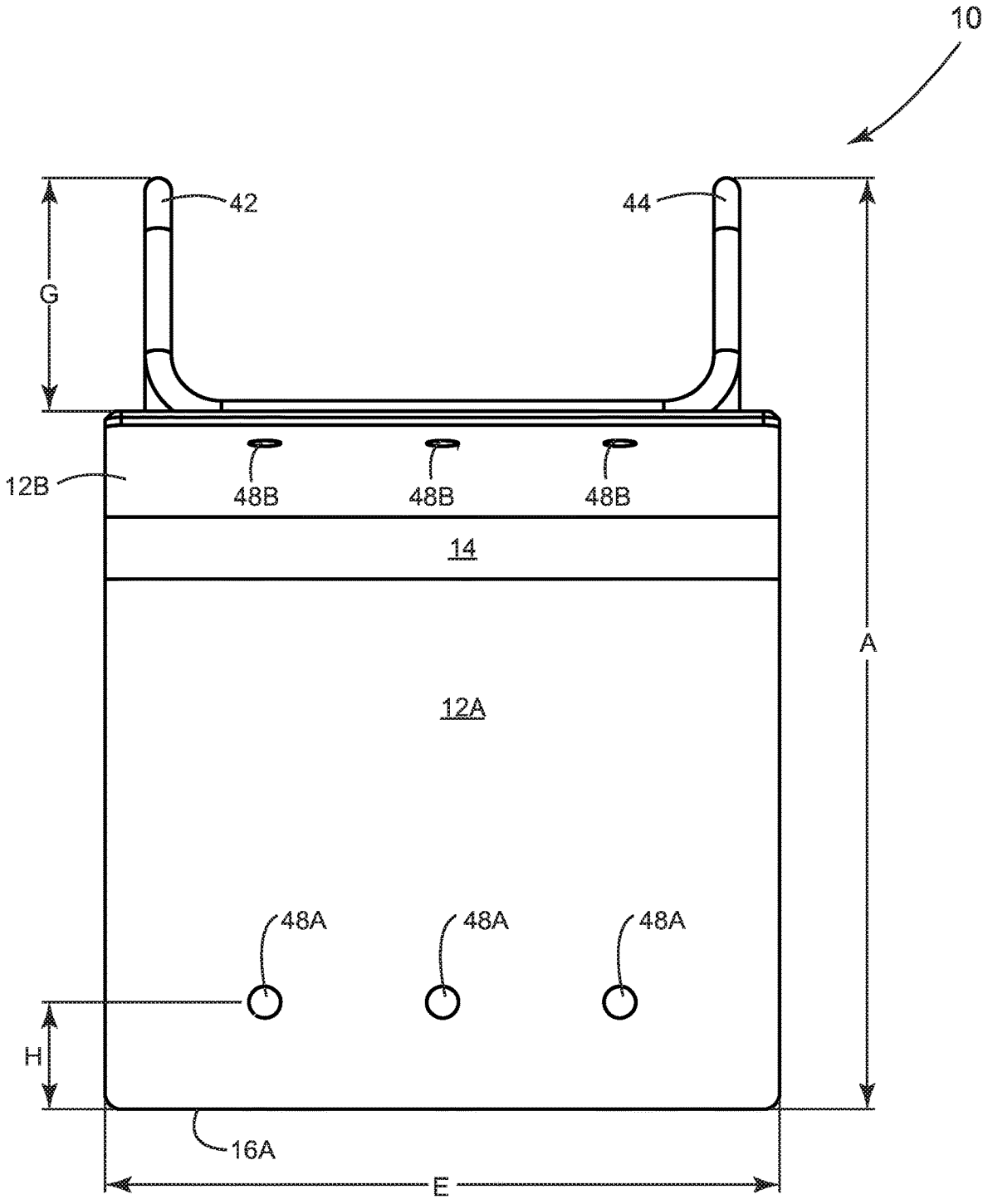
FIG. 6 is a top view showing the flip chair shown in FIGS. 1 through 5.

Referring to FIGS. 5 and 6, the inlaid magnets 48A on the first seat platform 12A are attached a distance H from the front seat edge 16A on the first seat platform 12A, and the inlaid magnets 48B are set a distance H' from the front seat edge 16B on the second seat platform 12B. In the preferred embodiment, the distances H and H' are the same, and are 5". FIG. 5 shows arrow I as the seat back height, which in the preferred embodiment is 28". The seat back height I is taken along the second seat plane and is not a vertical height, and it is longer than the seat depth D, D' because of the distance added in that direction for the platform transition 14.

Figure 7:
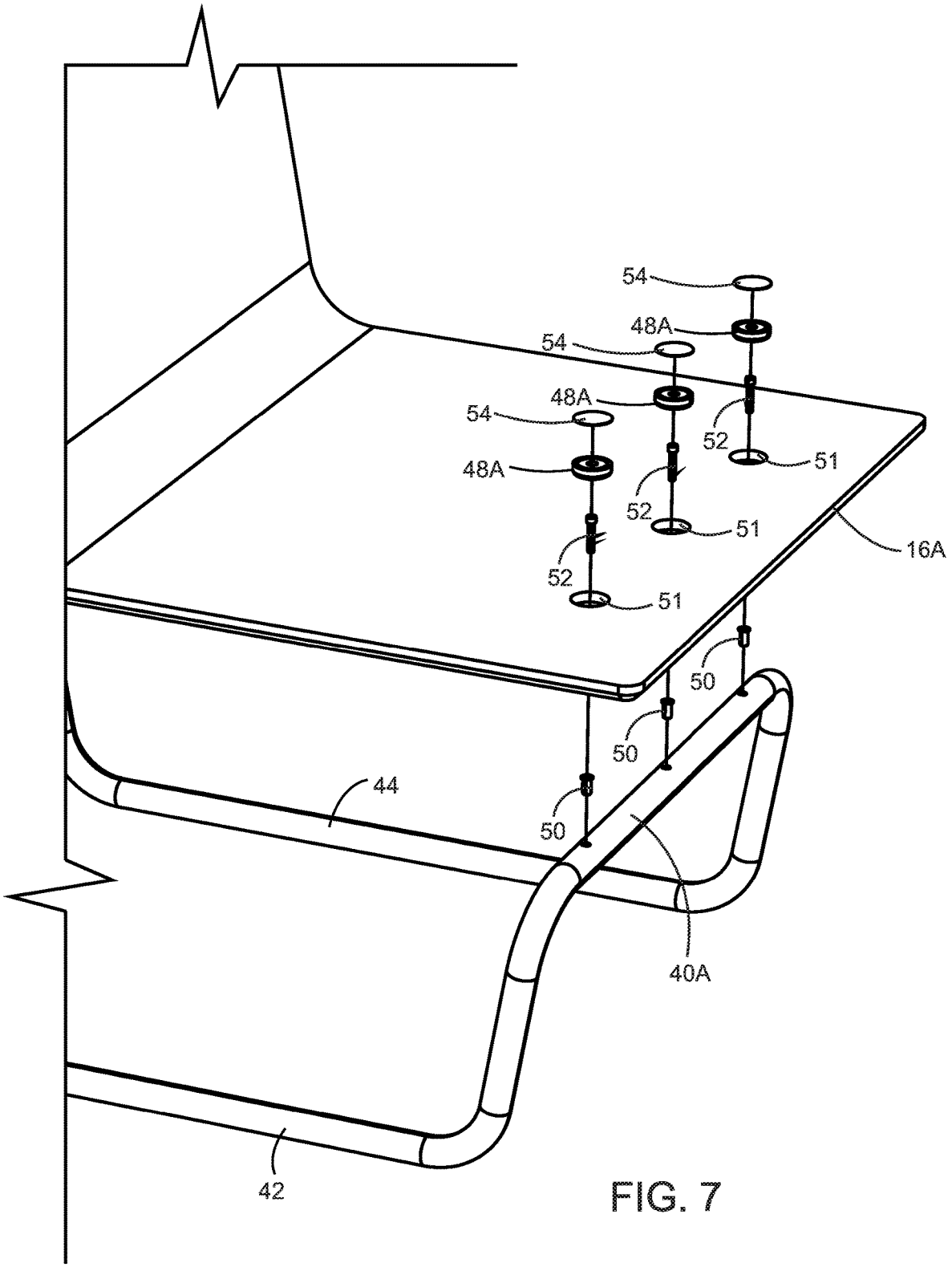
FIG. 7 is an exploded view illustrating the attachment of the seat platform to the front crossbar on the rail as well as magnets for securing the cushion shown in FIGS. 8 and 9.

Referring now to FIG. 7, cylindrical recesses 51A are positioned in the top surface of the first seat platform 12A. The recesses 51A are positioned linearly away from the front edge 16A with the center point at the distance H (FIG. 6). The cross support rail 40A has holes drilled into it, and grommets 50A are placed in the holes in the cross support rail 40. Screws 52A secure the cylindrical magnets in the respective recess 51A and the screws 52A are screwed tightly into the grommets 50A to attach the magnets 48A and the first seat platform 12A to the cross support rail 40A. Caps 54A are placed over the magnets 48A. The inlaid magnets 48A and the second seat platform 12A are attached to the cross support rail 40B in the same manner.

Figure 9:
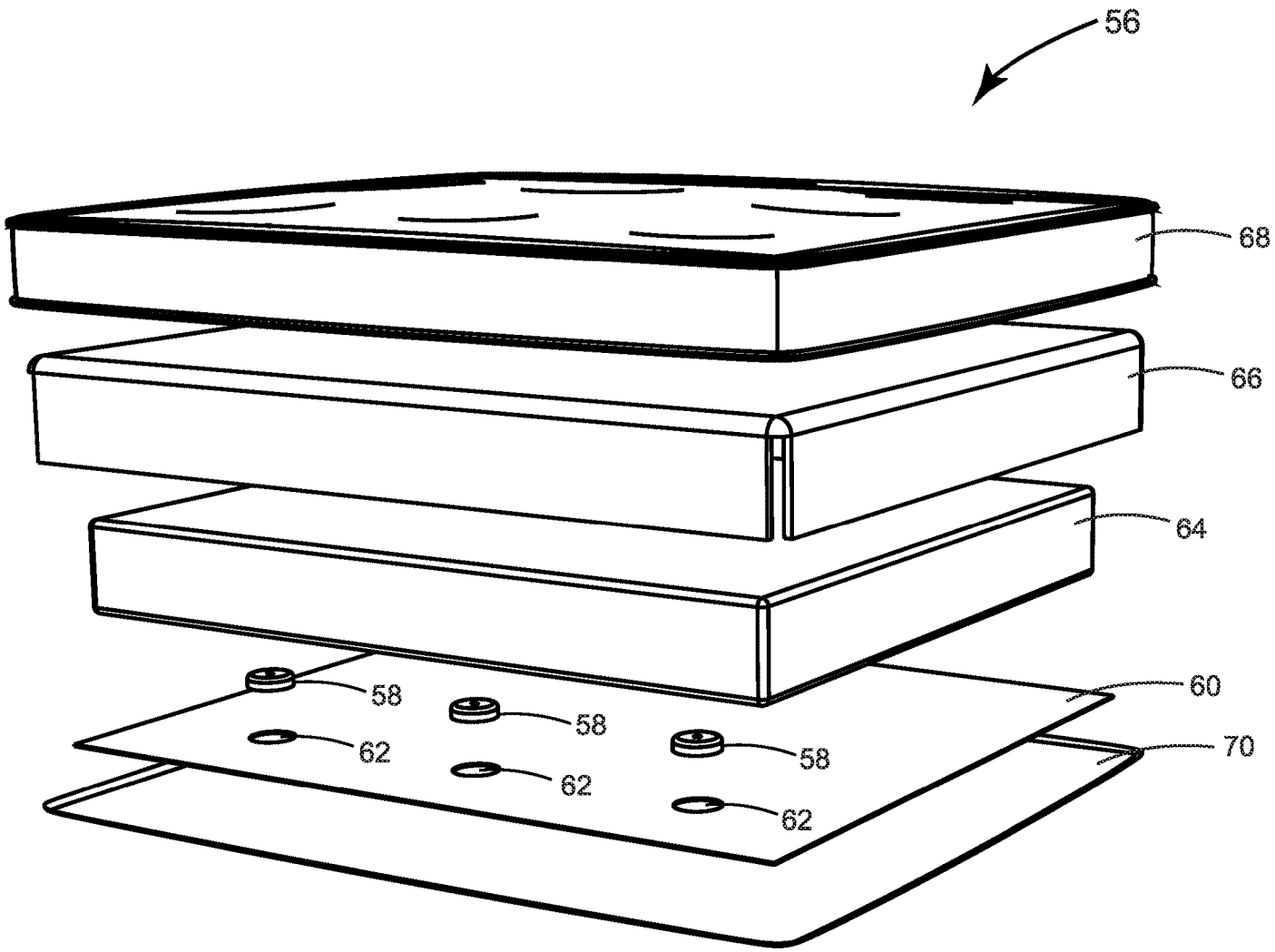
FIG. 9 is an exploded view of the cushion illustrated in FIG. 8.

FIGS. 8 and 9 show the construction of an exemplary cushion 56. The cushion includes a rigid or semi-rigid magnet template 60, for example made out of a relatively thin plastic or a relatively rigid batting material. The template 60 includes three magnet positioning holes 62A, 62B and 62C. The magnet positioning holes 62A, 62B and 62C are aligned a distance preferably corresponding to the distances H and H' (FIGS. 5 and 6) at which the inlaid magnets 48A, 48B are set back from the front edge 60A, 60B of the respective seat platform 12A, 12B. Magnets 58A, 58B and 58C are placed in the respective holes in the template 60. Foam padding 64 is laid over the template and holds the magnets 58A, 58B, 58C from leaving the respective holes 62A, 62B, 62C when the cushion 56 is fully assembled. A liner 66 covers the foam padding and a cover 68 and cover bottom 70 are enclosed around the other components, for example with a zipper or other means of fastening. The cushion 56 so constructed has magnets 58A, 58B, 58C which align with the inlaid magnets 48A, 48B on the chair seat platform 12A, 12B.

Figure 10:
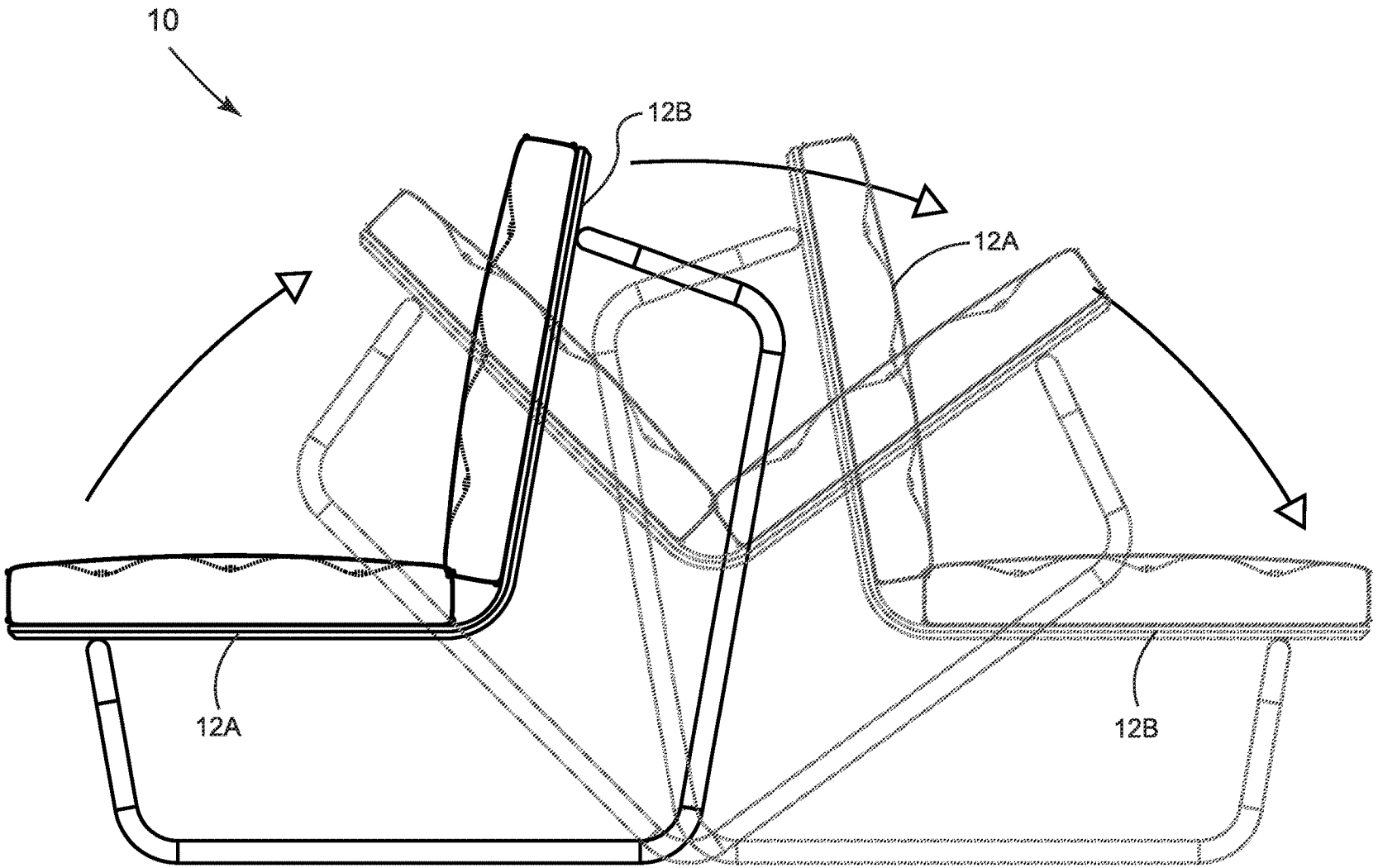
FIG. 10 illustrates the flip chair being flipped from a forward facing position to a rearward facing position.
Figure 11:
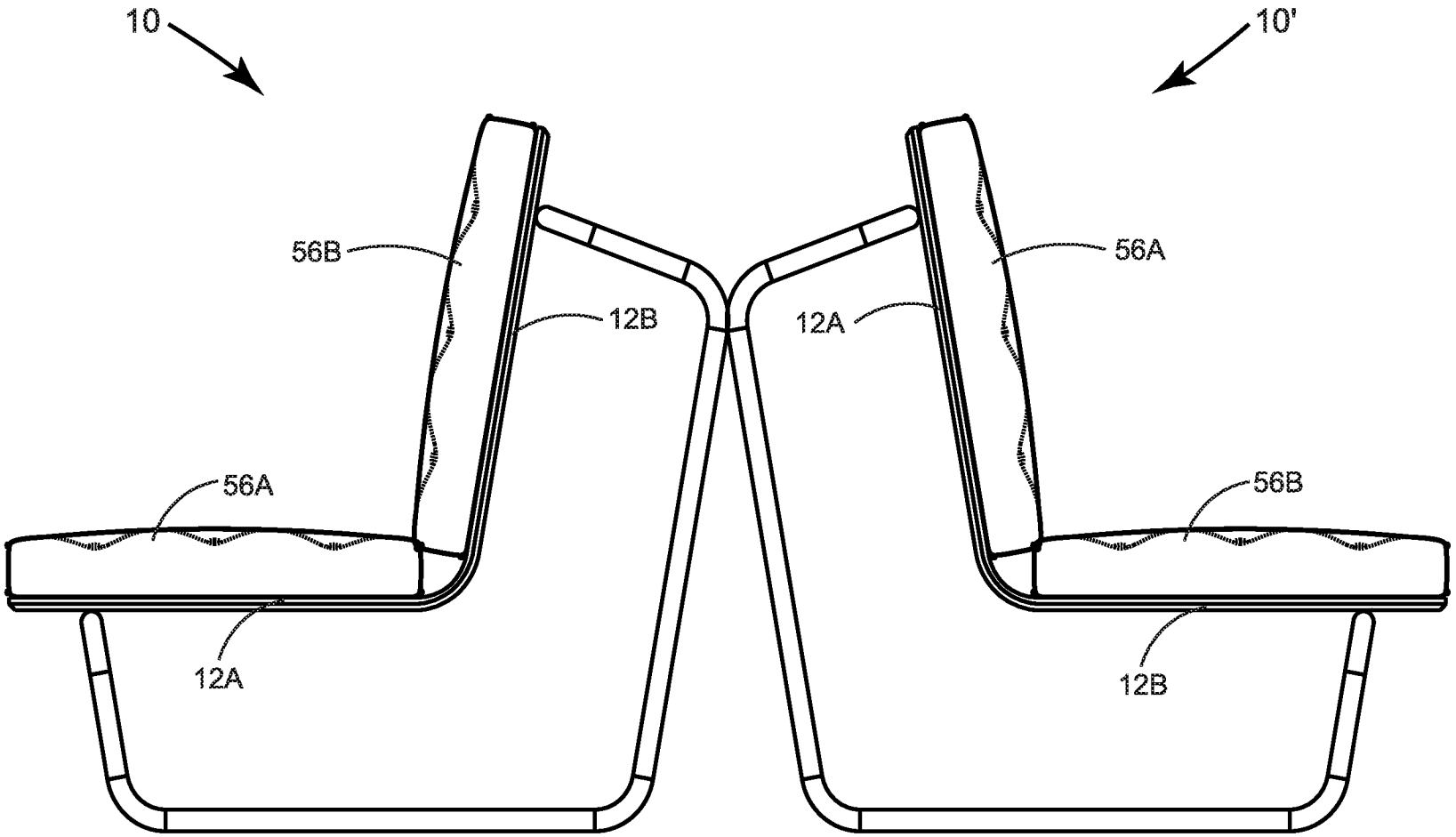
FIG. 11 shows the flip chair in a forward facing position 10 and in a rearward facing position 10'.

FIG. 11 shows two cushions 56A, 56B being magnetically attached to the first seat platform 12A and the second seat platform 12B. In FIG. 11, the chair on the left hand side is facing a forward direction. The chair 10' on the right side of FIG. 10 shows the chair after it has been flipped to face the rearward direction. Notes that the magnets keep the cushions attached when the chair 10 is flipped.

FIG. 10 shows the flipping action of the chair 10 from the forward position and in phantom to an intermediate position and a rearward facing position.

As mentioned, the concepts of this chair can be extended to a sofa.

What is claimed is:

1. A lounge chair comprising:

a first seat platform and a second seat platform, wherein the first seat platform serves as a first seat of the chair when the chair is in a forward position and the second seat platform serves as a first chair back when the chair is in the forward position; and wherein the second seat platform serves as a second seat of the chair when the chair is flipped into a rearward position and the first platform serves as a second chair back when the chair is in the rearward position; and a support structure for the first and second seat platforms which is configured to support the chair in a forward position with the first seat platform serving as the first seat of the chair and also in the rearward position with the second seat platform serving as the second seat of the chair;

wherein the support structure comprises:

a first and second support rail, where each rail has a first leg with a proximal end attached to the first seat platform near a front edge of the first seat and a distal end attached to a front end of a first rail footing which defines a plane substantially parallel to the first seat platform, and a second leg having a proximal end attached to the second seat platform near a front edge of the second seat and a distal end attached to a second rail footing which defines a plane substantially parallel to the second seat platform; and an arcing rail transition connecting a rear end of the first rail footing to a rear end of the second rail footing.

2. A lounge chair as recited in claim 1 wherein the first seat platform lies substantially in defines a first seat plane and the second seat platform lies substantially in defines a second seat plane, and the first and second seat planes intersect at a seat back inclination angle that is greater than 90°.

3. A lounge chair as recited in claim 1 wherein a first seat height when the chair is in the forward position is the same as a second seat height when the chair is in the rearward position.

4. The lounge chair recited in claim 1 further comprising a seat transition panel that spans between the first and second seat platforms to form a continuous surface between the seat and the chair back when the chair is in the forward position or in the rearward position.

5. The lounge chair recited in claim 1 wherein when the chair is in the forward position and supported on the first rail footing the rail transition is located farther rearward from the front edge of the first seat and down from the chair back and when the chair is in the rearward position and supported on the second rail footing the rail transition is located farther rearward from the front edge of the second seat and down from the chair back.

6. The lounge chair recited in claim 1 wherein the first seat platform and the second seat platform are planer planar.

7. The lounge chair recited in claim 1 wherein the first and second rails are connected by a first crossbar that is attached to the first seat platform and a second crossbar that is attached to the second seat platform; and the first seat platform includes inlaid first magnets that are connected with screws that also connect the first crossbar to the first seat platform and the second seat platform includes inlaid first magnets that are connected with screws that also connect the second crossbar to the second seat platform.

8. The lounge chair recited in claim 7 further comprising a first cushion attached to the first seat platform and a second cushion attached to the second seat platform wherein each cushion includes an exposed side, a hidden side, second magnets and a template for holding the second magnets in a fixed position corresponding to the location of the inlaid first magnets on the first and second seat platforms respectively.

9. The lounge chair recited in claim 1 in which the chair serves as a sofa inasmuch as the first and second seat platforms are large enough to seat more than one person.

10. A lounge chair comprising:

a first seat platform and a second seat platform, wherein the first seat platform serves as a first seat of the chair at a first seating height above a floor when the chair is a forward position and the second seat platform serves as a first chair back when the chair is in the forward position;

wherein the second seat platform serves as a second seat of the chair at a second seating height above the floor when the chair is flipped into a rearward position and the first platform serves as a second chair back when the chair is in the rearward position; and a support structure for the first and second seat platforms which is configured to support the chair in a forward position with the first seat platform serving as the seat of the chair and also in the rearward position with the second seat platform serving as the seat of the chair, and wherein the support structure comprises a first side support and a second side support, where each side support has a first end attached to the first seat platform near a front edge of the first seat, a first footing surface, which respective footing surfaces define a plane substantially parallel to the first seat platform and spaced apart from the first seat platform at a distance substantially equal to the first seating height, a second end attached to the second seat platform near a front edge of the second seat, a second footing surface, which respective footing surfaces define a plane substantially parallel to the second seat platform and spaced apart from the second seat platform at a distance substantially equal to the second seating height, and an arcing transition surface connecting a rear end of the first footing surface to a rear end of the second footing surface; and further wherein a portion of the first footing surface is located rearward of the second seat platform when the chair is in a forward position and a portion of the second footing surface is located rearward of the first seat platform when the chair is in a rearward position.

11. A lounge chair as recited in claim 10 wherein the first seat platform defines a first seat plane and the second seat platform defines a second seat plane, and the first and second seat planes intersect at a seat back inclination angle that is greater than 90°.

12. A lounge chair as recited in claim 10 wherein a first seat height when the chair is in the forward position is the same as a second seat height when the chair is in the rearward position.

13. The lounge chair recited in claim 10 further comprising a seat transition panel that spans between the first and second seat platforms to form a continuous surface between the seat and the chair back when the chair is in the forward position or in the rearward position.

14. The lounge chair recited in claim 10 wherein the first seat platform and the second seat platform are planar.

15. The lounge chair recited in claim 10 in which the chair serves as a sofa inasmuch as the first and second seat platforms are large enough to seat more than one person.

16. The lounge chair recited in claim 10 further comprising a first cushion attached to the first seat platform and a second cushion attached to the second seat platform.

17. The lounge chair as recited in claim 16 wherein the first seat platform includes inlaid first magnets and the first cushion includes an exposed side, a hidden side, second magnets and a template for holding the second magnets in a fixed position corresponding to the location of the inlaid first magnets on the first seat platform; and the second seat platform includes inlaid first magnets and the second cushion includes an exposed side, a hidden side, second magnets and a template for holding the second magnets in a fixed position corresponding to the location of the inlaid first magnets on the second set platform.

* * * * *